US008921696B2

(12) United States Patent
Otsuka et al.

(10) Patent No.: US 8,921,696 B2
(45) Date of Patent: Dec. 30, 2014

(54) WIRING HARNESS AND A METHOD FOR PRODUCING THE SAME, AND A METHOD FOR CONNECTING INSULATED WIRES

(75) Inventors: Yasuyuki Otsuka, Yokkaichi (JP); Takehiro Hosokawa, Yokkaichi (JP); Masato Inoue, Yokkaichi (JP); Fumitoshi Imasato, Yokkaichi (JP)

(73) Assignees: Sumitomo Wiring Systems, Ltd., Mie (JP); Autonetworks Technologies, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 133 days.

(21) Appl. No.: 12/450,270

(22) PCT Filed: Sep. 17, 2008

(86) PCT No.: PCT/JP2008/066778

§ 371 (c)(1),
(2), (4) Date: Sep. 18, 2009

(87) PCT Pub. No.: WO2009/038099

PCT Pub. Date: Mar. 26, 2009

(65) Prior Publication Data

US 2010/0096185 A1 Apr. 22, 2010

(30) Foreign Application Priority Data

Sep. 18, 2007 (JP) ..... 2007-240677

(51) Int. Cl.
*H01R 4/02* (2006.01)
*H01R 43/02* (2006.01)

(52) U.S. Cl.
CPC ..... *H01R 43/0207* (2013.01); *H01R 4/021* (2013.01)
USPC ..... 174/74 R; 174/94 R

(58) Field of Classification Search
USPC ..... 174/74 R, 84 C, 94 R
See application file for complete search history.

(56) References Cited

U.S. PATENT DOCUMENTS 2,656,204 A * 10/1953 Blomstrand ..... 403/18
2,792,560 A * 5/1957 Bollmeier ..... 439/245

(Continued)

FOREIGN PATENT DOCUMENTS

CN 101517846 A 8/2009
DE 1 515 399 9/1969

(Continued)

OTHER PUBLICATIONS

Nov. 13, 2012 Office Action issued in Japanese Patent Application No. 2007-240677 (with translation.).

(Continued)

*Primary Examiner* — Chau N Nguyen
(74) *Attorney, Agent, or Firm* — Oliff PLC

(57) ABSTRACT

A wiring harness which is excellent in peel strength at a joining portion where conductors of electric wires are joined together, even if at least one of the electric wires have a small diameter. A wiring harness includes insulated wires whose conductors are partly exposed, and a metal leaf with which the exposed conductors are bound, where the bound conductors are welded preferably by ultrasonic welding, and the conductors including elemental wires have a joining portion where the elemental wires are joined together, the joining portion being inside the metal leaf. The elemental wires and the metal leaf are preferably made from copper, a copper alloy, aluminum and/or an aluminum alloy, and are preferably made from a same metal or a same alloy. At least one of the conductors preferably has a cross-sectional area of 0.35 $mm^2$ or less.

10 Claims, 3 Drawing Sheets

(56) References Cited

U.S. PATENT DOCUMENTS

| | | | | |
|---|---|---|---|---|
| 3,469,020 | A | 9/1969 | Broom et al. | |
| 4,135,296 | A * | 1/1979 | Kami et al. | 29/882 |
| 4,221,457 | A * | 9/1980 | Allen et al. | 439/874 |
| 5,331,113 | A * | 7/1994 | Soni et al. | 174/87 |
| 5,906,044 | A | 5/1999 | Fujii et al. | |
| 6,576,844 | B1 * | 6/2003 | Kamata | 174/126.1 |
| 6,641,444 | B2 * | 11/2003 | Hanazaki et al. | 439/877 |
| 2009/0218134 | A1 * | 9/2009 | Stroh et al. | 174/74 R |

FOREIGN PATENT DOCUMENTS

| | | |
|---|---|---|
| GB | 954618 | 4/1964 |
| GB | 2 282 922 A | 4/1995 |
| JP | A-55-113279 | 9/1980 |
| JP | A-6-60739 | 3/1994 |
| JP | U 6-41028 | 5/1994 |
| JP | A 8-283506 | 10/1996 |
| JP | A 8-283507 | 10/1996 |
| JP | A 9-155573 | 6/1997 |
| JP | A-10-172710 | 6/1998 |
| JP | A-2002-191109 | 7/2002 |
| JP | A 2005-322544 | 11/2005 |
| JP | A-2006-147507 | 6/2006 |

OTHER PUBLICATIONS

Office Action issued in corresponding Chinese Application No. 200880018770.1 on Sep. 7, 2011. (with English language translation).

Office Action issued in corresponding Chinese Application No. 200880018770.1 on Feb. 11, 2011, with English Language Translation.

Search Report issued in European Patent Application No. 08831999.1, on Oct. 14, 2010.

* cited by examiner

WIRING HARNESS AND A METHOD FOR PRODUCING THE SAME, AND A METHOD FOR CONNECTING INSULATED WIRES

TECHNICAL FIELD

The present invention relates to a wiring harness and a method for producing the same, and a method for connecting insulated wires, and more specifically relates to a wiring harness which is suitably used in carrying out wiring of an automotive vehicle and a method for producing the same, and a method for connecting insulated wires.

BACKGROUND ART

Conventionally, a plurality of insulated wires are used in a vehicle such as an automotive vehicle. The insulated wires are usually bunched into a wiring harness. In a case where some of the insulated wires in the wiring harness are connected together, they are connected such that insulators of the insulated wires are first stripped off to expose conductors inside the insulators and then the connection is established with the conductors in contact with each other using a connection method such as welding and crimping.

Recently, as the method for connecting electric wires, an ultrasonic welding method has been often used considering its easy operation and reliable connecting capability.

For example, an ultrasonic welding method is disclosed in Japanese Patent Application Unexamined Publication No. 2005-322544, by which insulated wires are connected together by bunching them together and stranding exposed conductors of the insulated wires and then welding a stranded portion of the exposed conductors.

Another ultrasonic welding method is disclosed in Japanese Patent Application Unexamined Publication No. Hei 09-155573, by which insulated wires are connected together by interposing a resin between conductors of the insulated wires which are subjected to ultrasonic welding and then welding the conductors together, and at the same time, the resin is made to invade between the conductors, whereby connection strength between the insulated wires is improved.

DISCLOSURE OF THE INVENTION

Problem to be Solved by the Invention

In the field of automobiles, however, since electric wires to be used in carrying out wiring of an automotive vehicle have been reduced in diameter year by year recently in an attempt to achieve weight reduction of the electric wires for the purpose of weight reduction of the automotive vehicle, the electric wires decrease in strength due to the reduced diameters and some problems concerning strength have been caused, one example of which is that peel strength of a joining portion where conductors of the electric wires are joined together falls below specifications.

In addition, in a case where a stainless steel wire, a copper alloy wire or an aluminum alloy wire which functions as a reinforcement wire is included in a conductor in order to improve the strength of the conductor, a problem is caused that when conductors of a plurality of electric wires are joined together, a joining portion between dissimilar metals significantly decreases in peel strength.

An object of the present invention is to provide a wiring harness which is excellent in peel strength at a joining portion where conductors of electric wires are joined together even if at least one of the electric wires have a small diameter.

Another object of the present invention is to provide a method for producing the wiring harness excellent in peel strength at the joining portion. Yet, another object of the present invention is to provide a method for connecting insulated wires, with which excellent peel strength is brought about.

Means for Solving Problem

As a result of keen examination by the inventors of the present invention, they succeeded in obtaining a wiring harness which is excellent in peel strength at a joining portion where conductors of electric wires are joined together. It is notable that the inventors found that in a case where at least one of the conductors includes wires made from dissimilar metals, such as a case where at least one of the conductors includes a copper elemental wire and a stainless steel wire, if the conductors are joined together while the stainless steel wire is surrounded with the copper elemental wires, the wiring harness is excellent in peel strength at the joining portion. In other words, the inventors found that it is essential only that the wire made from the dissimilar metal of a stainless steel should not come out to the surface of the conductor. In addition, the inventors found that by using the wiring harness, peel strength at the joining portion of the electric wires is effectively improved even if at least one of the electric wires has a small diameter.

Thus, to achieve the objects and in accordance with the purpose of the present invention, the wiring harness according to preferred embodiments of the present invention includes a plurality of insulated wires whose conductors are partly exposed, and a metal leaf or a metal wire with which the exposed conductors are bound, wherein the conductors including elemental wires have a joining portion where the elemental wires are joined together, the joining portion being inside the metal leaf or the metal wire which is wound around the joining portion.

In the wiring harness, the elemental wires are joined together preferably by ultrasonic welding or resistance welding.

The metal leaf and the metal wire are preferably made from a same metal as a metal from which the elemental wires are made, or an alloy of the metal.

The elemental wires are preferably made from one or more metals selected from the group consisting of copper, a copper alloy, aluminum, and an aluminum alloy.

At least one of the conductors may further include a reinforcement wire.

A cross-sectional area of at least one of the conductors is preferably 0.35 $mm^2$ or less.

A total thickness of the metal leaf covering the conductors is preferably in a range of 0.02 to 0.4 mm.

Alternatively, the diameter of the metal wire is preferably in a range of 0.05 to 0.5 mm.

Further, the metal wire is wound around the conductors preferably at intervals of 1 to 50 times the diameter of the metal wire.

In another aspect of the present invention, a method for producing a wiring harness includes the steps of partly exposing conductors of a plurality of insulated wires, binding the insulated wires at sites where the conductors are exposed with a metal leaf or a metal wire, and joining elemental wires which are included in the conductors while the conductors are bound together.

In this method, the elemental wires are joined together preferably by ultrasonic welding or resistance welding.

Yet, in another aspect of the present invention, a method for connecting insulated wires includes the steps of partly exposing conductors of a plurality of insulated wires, binding the insulated wires at sites where the conductors are exposed with a metal leaf or a metal wire, and joining elemental wires which are included in the conductors while the conductors are bound together.

In this method, the elemental wires are joined together preferably by ultrasonic welding or resistance welding.

Effects of the Invention

Since the wiring harness according to the preferred embodiments of the present invention has the configuration that the insulated wires whose conductors are partly exposed are bound with the metal leaf or the metal wire at the sites where the conductors are exposed, where the conductors including the elemental wires have the joining portion where the elemental wires are joined together which is inside the metal leaf or the metal wire wound around the joining portion, in other words, since the elemental wires of the conductors are joined together in the state of being bound with the metal leaf or the metal wire, the elemental wires are not easily moved during the joining.

Accordingly, even when at least one of the conductors includes a dissimilar-metal wire such as a stainless steel wire, the structure of the conductors is not easily broken down. Further, if the dissimilar-metal wire is made surrounded in advance with the elemental wires, the dissimilar-metal wire is not exposed to the surface of the conductor. Therefore, the dissimilar-metal wire does not easily peel off the conductor, so that the wiring harness is excellent in peel strength at the joining portion.

In addition, even when the dissimilar-metal wire is not made surrounded with the elemental wires when at least one of the conductors includes the dissimilar-metal wire, the dissimilar-metal wire is not exposed to the surface of the conductor because it is covered with the metal leaf or the metal wire, so that the wiring harness is excellent in peel strength at the joining portion.

Further, the metal leaf or the metal wire wound around the joining portion functions as a resistance to the force tearing the joining portion, so that the wiring harness is more improved in peel strength at the joining portion.

Owing to this function, the wiring harness is excellent in peel strength at the joining portion even in a case where the wiring harness tends to decrease in joining strength between the elemental wires, such as a case where at least one of the connected insulated wires has a small diameter, and a case where dissimilar-metal wires are joined together.

If the elemental wires are joined together by ultrasonic welding or resistance welding, the wiring harness is especially excellent in peel strength at the joining portion.

In this case, if the metal leaf and the metal wire are made from the same metal as the metal from which the elemental wires are made or the alloy of the metal, not only the elemental wires of the conductors are joined together but also the elemental wires and the metal leaf, or the elemental wires and the metal wire are joined together, and accordingly the wiring harness is more excellent in peel strength at the joining portion.

If the elemental wires are made from one or more metals selected from the group consisting of copper, a copper alloy, aluminum, and an aluminum alloy, the peel strength at the joining portion is effectively improved.

If at least one of the conductors includes the reinforcement wire such as a stainless steel wire, i.e., a dissimilar-metal wire, especially an excellent improvement effect in peel strength at the joining portion is produced.

If at least one of the conductors has the cross-sectional area of 0.35 $mm^2$ or less, in other words, if at least one of the insulated wires is a so-called small-diameter insulated wire, especially an excellent improvement effect in peel strength at the joining portion is produced.

In this case, if the total thickness of the metal leaf covering the conductors is in the range of 0.02 to 0.4 mm, an excellent improvement effect in peel strength at the joining portion is produced.

Alternatively, if the diameter of the metal wire is in the range of 0.05 to 0.5 mm, an excellent improvement effect in peel strength at the joining portion is produced.

In this case, if the metal wire is wound around the conductors at the intervals of 1 to 50 times the diameter of the metal wire, an excellent improvement effect in peel strength at the joining portion is further produced.

Meanwhile, by the method for producing a wiring harness according to the preferred embodiment of the present invention, which includes the steps of partly exposing conductors of a plurality of insulated wires, binding the insulated wires at sites where the conductors are exposed with a metal leaf or a metal wire, and joining elemental wires which are included in the conductors while the conductors are bound together, a wiring harness can be produced which is excellent in peel strength at a joining portion where the elemental wires are joined together.

In this method, if the elemental wires are joined together by ultrasonic welding or resistance welding, the wiring harness is especially excellent in peel strength at the joining portion.

In addition, by the method for connecting insulated wires according to the preferred embodiment of the present invention, which includes the steps of partly exposing conductors of a plurality of insulated wires, binding the insulated wires at sites where the conductors are exposed with a metal leaf or a metal wire, and joining elemental wires which are included in the conductors while the conductors are bound together, the insulated wires can be connected and thereby excellent peel strength at a joining portion where the elemental wires are joined together is produced.

In this method, if the elemental wires are joined together by ultrasonic welding or resistance welding, the insulated wires can be connected and thereby excellent peel strength at the joining portion is further produced.

BEST MODE FOR CARRYING OUT THE INVENTION

A detailed description of preferred embodiments of the present invention will now be provided.

Figure 1:
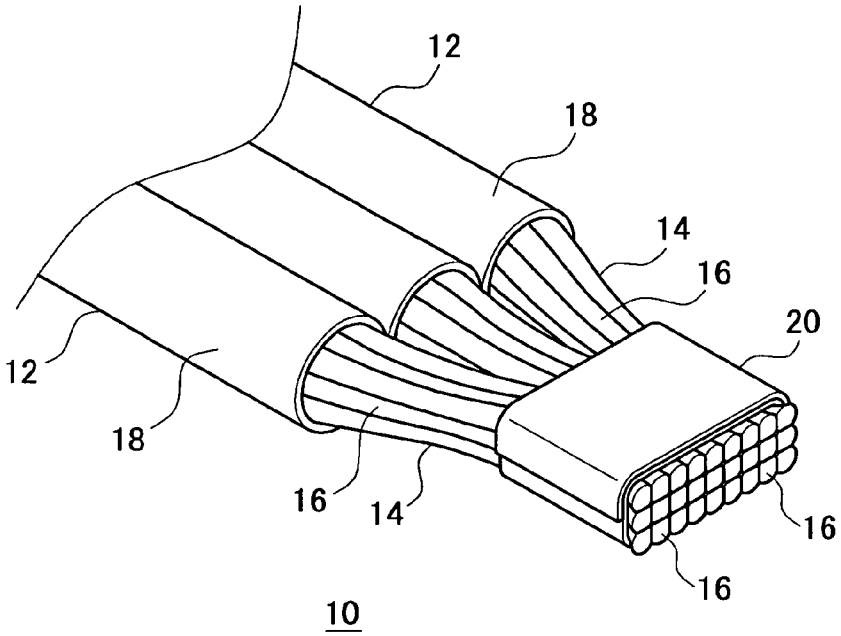
FIG. 1 is a view schematically showing a wiring harness according to a preferred embodiment of the present invention.

As shown in FIG. 1, a wiring harness 10 according to one of the preferred embodiments of the present invention includes a plurality of insulated wires 12 which are each prepared by covering a conductor 14 with an insulator 18. Each conductor 14 includes one or more than one elemental wire 16 which functions as an electric conductor. Each conductor 14 may include only the one or more than one elemental wire 16, or at least one of the conductors 14 may further include a reinforcement wire (a tension member) in order to improve conductor strength.

In the plurality of insulated wires 12, the insulators 18 are partially stripped off and the conductors 14 inside the insulators 18 are exposed. The insulated wires 12 are bound at sites where the conductors 14 are exposed with a metal leaf 20 (hereinafter, the sites where the conductors 14 are exposed are referred to as the "exposed conductors 14"), and thus the bound sites of the exposed conductors 14 are covered with the metal leaf 20. Besides, the insulators 18 of the insulated wires 12 may be stripped off at the end portions of the insulated wires 12, or at the middle portions of the insulated wires 12.

In the bound exposed conductors 14, the included elemental wires 16 are joined together inside the metal leaf 20. To be specific, an elemental wire 16 included in a conductor 14 of one insulated wire 12 and an elemental wire 16 included in a conductor 14 of another insulated wire 12 are joined together to provide a joining portion, and accordingly the conductors 14 of the insulated wires 12 are joined together at the joining portion.

The joining portion where the elemental wires 16 of the conductors 14 are joined together does not have to be provided entirely over a contact portion between the elemental wires 16 of the conductors 14, and may be provided partially over the contact portion. It is essential only that the joining portion where the elemental wires 16 of the conductors 14 are joined together should be inside the metal leaf 20 with which the elemental wires 16 of the exposed conductors 14 are bound.

It is to be noted that, in general, when a conductor including a copper wire which functions as an elemental wire and a stainless steel wire which functions as a reinforcement wire is joined with another conductor, a joining portion between dissimilar metals of copper and a stainless steel is provided; however, since a high-strength material such as a stainless steel from which the reinforcement wire is made greatly differs in deformation resistance from copper from which the elemental wires are made, only the copper wires deform at the time of the joining while the stainless steel wire deforms little. For this reason, the joining force between the copper wires and the stainless steel wire is remarkably weaker than the joining force between the copper wires.

In addition, when the conductor including the copper wire and the stainless steel wire is joined with another conductor, the stainless steel wire sometimes comes out to the surface of the conductor depending on conditions of the joining and in such a case the stainless steel wire tends to peel off the copper wires, resulting in decrease in peel strength of the joining portion.

Meanwhile, in the wiring harness 10, since the exposed conductors 14 are bound with the metal leaf 20 and the elemental wires 16 included in the conductors 14 are joined together while the conductors 14 are bound with the metal leaf 20, copper wires which function as the elemental wires 16 and a stainless steel wire which functions as the reinforcement wire are not easily moved during the joining. Further, if the stainless steel wire is made surrounded in advance with the copper wires, the stainless steel wire is not exposed to the surface of the conductor 14. In addition, even if the stainless steel wire is not made surrounded in advance with the copper wires, the stainless steel wire is not exposed to the surface of the conductor 14 because it is covered with the metal leaf 20.

Accordingly, the wiring harness 10 has a configuration such that the metal leaf 20 covers the joining portion all the time and the stainless steel wire does not come out to the surface of the conductor 14 without being affected by the joining conditions. Owing to this configuration, the stainless steel wire does not easily peel off the copper wires, and thus the wiring harness 10 is excellent in peel strength at the joining portion with stability.

In order to tear the joining portion, it is necessary to not only tear apart the joined elemental wires 16 but also to tear the wound metal leaf 20 at the same time. In other words, the metal leaf 20 covering the joining portion functions as a resistance to the force tearing the joining portion, so that the wiring harness 10 is more improved in peel strength at the joining portion.

Figure 2:
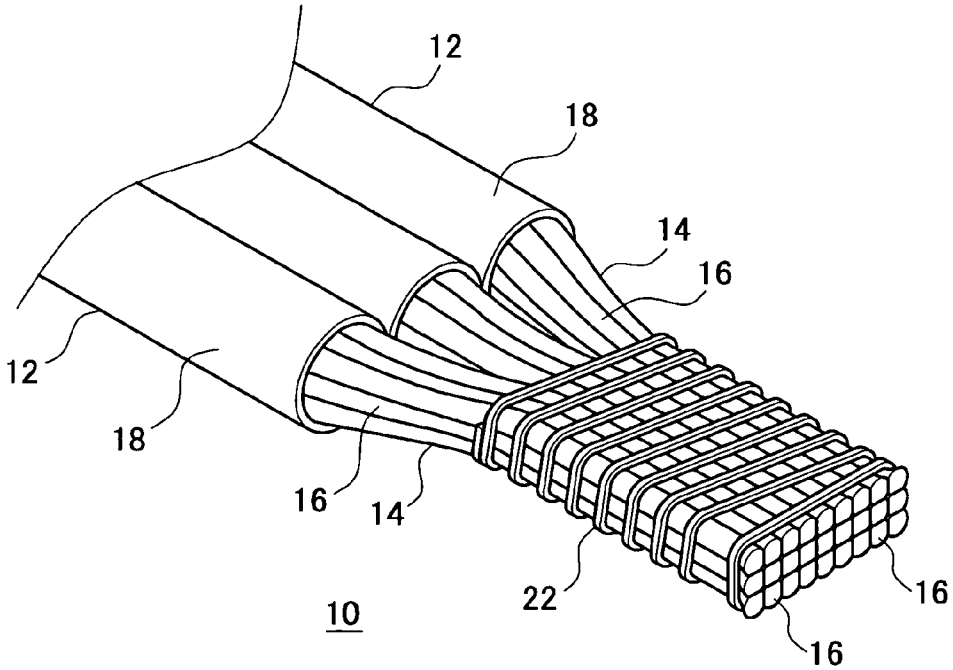
FIG. 2 is a view schematically showing a wiring harness according to another preferred embodiment of the present invention.

Next, a description of the wiring harness 10 according to another preferred embodiment of the present invention will be provided referring to FIG. 2. The wiring harness 10 shown in FIG. 2 is different from the wiring harness 10 shown in FIG. 1 in that, instead of being bound with the metal leaf 20, the plurality of insulated wires 12 of which the insulators 18 are partially stripped off and the conductors 14 inside the insulators 18 are exposed are bound at the sites where the conductors 14 are exposed with a metal wire 22. The constituent elements other than the metal wire 22 of the wiring harness 10 shown in FIG. 2 are the same as those shown in FIG. 1.

Accordingly, the joining portion where the elemental wires 16 of the conductors 14 are joined together is inside the metal wire 22 which is wound around the joining portion, so that a portion is provided in the joining portion where the elemental wires 16 do not come out to the surfaces of the conductors 14. Owing to this configuration, the wiring harness 10 is improved in peel strength at the joining portion. The metal wire 22 covering the joining portion functions as a resistance to the force tearing the joining portion, so that the wiring harness 10 is more improved in peel strength at the joining portion.

The wiring harness 10 of which the exposed conductors 14 are bound with the metal leaf 20 shown in FIG. 1 has advantages such as excellent productivity. Meanwhile, the wiring harness 10 of which the exposed conductors 14 are bound with the metal wire 22 shown in FIG. 2 has advantages such as capability to easily obtain higher peel strength.

Examples of a method for joining the elemental wires 16 include an ultrasonic welding method and a resistance welding method. Among these methods, the ultrasonic welding method is preferably used considering its easy operation and reliable joining capability.

The elemental wires 16 are preferably made from a metal which has excellent conductivity, such as copper, a copper alloy, aluminum, and an aluminum alloy. When each conductor 14 includes two or more than two elemental wires 16, the elemental wires 16 included in each conductor 14 may be of a kind, or may be of two or more different kinds.

The reinforcement wire is included in at least one of the conductors 14 and has the function of improving conductor strength such as tensile strength. It is essential only that the reinforcement wire should be made from a metal such as a stainless steel and a high-strength fiber which has strength higher than the conductive metal from which the elemental wires 16 are made. The reinforcement wire may be equal in diameter to the elemental wires 16, or may be larger or smaller in diameter than the elemental wires 16. Besides, when the elemental wires 16 are made from an alloy material such as a copper alloy and an aluminum alloy, the elemental wires 16 function also as reinforcement wires.

The metal leaf 20 and the metal wire 22 are preferably made from a same metal as the metal from which the elemental wires 16 of the conductors 14 are made, or an alloy of the metal, though the metal from which the metal leaf 20 and the metal wire 22 are made is not limited specifically. For example, when the elemental wires 16 are made from copper, the metal leaf 20 and the metal wire 22 are preferably made from copper or a copper alloy, and when the elemental wires 16 are made from aluminum, the metal leaf 20 and the metal wire 22 are preferably made from aluminum or an aluminum alloy.

If the metal leaf 20 and the metal wire 22 are made from a same metal as the metal from which the elemental wires 16 are made or an alloy of the metal, not only the elemental wires 16 of the conductors 14 but also the elemental wires 16 and the metal leaf 20 or the elemental wires 16 and the metal wire 22 are joined together, so that the wiring harness 10 is more improved in peel strength at the joining portion.

When two or more kinds of elemental wires 16 are included in each conductor 14, it is preferable that the metal leaf 20 and the metal wire 22 are made from a same metal as a metal among the metals from which the elemental wires 16 are made, or an alloy of the metal. More preferably, the metal leaf 20 and the metal wire 22 are made from a same metal as the softest metal among the metals from which the elemental wires 16 are made, or an alloy of the metal. This is because the elemental wires 16 and the metal leaf 20 or the elemental wires 16 and the metal wire 22 are more easily joined together.

Specific examples of the metal from which the metal leaf 20 and the metal wire 22 are made include copper, a copper alloy, aluminum, and an aluminum alloy.

A total thickness of the metal leaf 20 covering the conductors 14 is preferably in the range of 0.02 to 0.4 mm. The total thickness of the metal leaf 20 is determined considering the thickness of the metal leaf 20 itself and a winding number of the metal leaf 20. This is because if the total thickness is less than 0.02 mm, an improvement effect in peel strength is difficult to produce. On the other hand, if the total thickness is more than 0.4 mm, the metal leaf 20, if thin, becomes very large in winding number, which results in low productivity, while the metal leaf 20, if thick, has diminished adhesive properties to the conductors 14 when wound around them, which results in decrease in peel strength. More preferably, the total thickness is in the range of 0.02 to 0.3 mm, and still more preferably, the total thickness is in the range of 0.1 to 0.2 mm.

The winding number is preferably in the range of 1 to 10 times considering productivity, and the thickness of the metal leaf 20 is preferably in the range of 0.01 to 0.3 mm considering the winding number. More preferably, the winding number is in the range of 1 to 3 times, and the thickness of the metal leaf 20 is in the range of 0.05 to 0.15 mm.

The metal wire 22 with which the exposed conductors 14 are bound is preferably a thin metal wire. The metal wire 22 is preferably in the range of 0.05 to 0.5 mm in diameter. This is because if the metal wire 22 is less than 0.05 mm in diameter, an improvement effect in peel strength is difficult to produce. On the other hand, if the metal wire 22 is more than 0.5 mm in diameter, it has diminished adhesive properties to the conductors 14 when wound around them, which results in decrease in peel strength. More preferably, the metal wire 22 is in the range of 0.1 to 0.45 mm in diameter, and still more preferably, the metal wire 22 is in the range of 0.2 to 0.35 mm in diameter.

The metal wire 22 is wound around the conductors 14 preferably at intervals of 1 to 50 times the diameter of the metal wire 22. This is because if the metal wire 22 is wound around the conductors 14 at intervals of less than 1 time the diameter of the metal wire 22, the metal wire 22 wound around the conductors 14 overlaps with itself and the shape of the metal wire 22 is not stabilized, so that stable peel strength is not easily obtained. On the other hand, if the metal wire 22 is wound around the conductors 14 at intervals of more than 50 times the diameter of the metal wire 22, an improvement effect in peel strength decreases since the intervals are too large. More preferably, the metal wire 22 is wound around the conductors 14 at intervals of 10 to 20 times the diameter of the metal wire 22.

The insulators 18 are preferably made from a resin material having insulation properties such as polyvinyl chloride (PVC) and a non-halogenous resin though the insulation material is not limited specifically. In particular, a material which is excellent in flame retardancy is preferably used. A covering thickness of each insulator 18 is preferably in the range of 0.1 to 0.3 mm though the covering thickness is not limited specifically.

The wiring harness 10 according to the preferred embodiments of the present invention can be favorably used also as a wiring harness which has a configuration such that electric wires included therein have a small diameter, or as a wiring harness which has a configuration such that a stainless steel wire which functions as a reinforcement wire is included in addition to a copper wire or an aluminum wire. To be specific, in the above-obtained wiring harnesses, decrease in peel strength at the joining portion is suppressed and consequently excellent peel strength can be obtained when the small-diameter electric wires are joined together or when the electric wires made from the dissimilar metals are joined together.

A cross-sectional area of at least one of the conductors 14 of the insulated wires 12 which make up the wiring harness 10 is preferably 0.35 $mm^2$ or less considering that an excellent improvement effect in peel strength is produced especially in small-diameter electric wires, though the cross-sectional area is not limited specifically.

In the wiring harness 10 according to the preferred embodiments of the present invention, some of insulated wires 12 may be connected, or all of the insulated wires 12 may be connected.

Next, a description of a method for producing a wiring harness according to a preferred embodiment of the present invention will be provided.

The method for producing a wiring harness includes the steps of partly exposing conductors of a plurality of insulated wires, binding the insulated wires at sites where the conductors are exposed with a metal leaf or a metal wire, and joining elemental wires which are included in the conductors while the conductors are bound together.

In the step of partly exposing conductors of plurality of insulated wires, a plurality of insulated wires are first prepared, insulators of the insulated wires to be connected together are partially stripped off only the length necessary to connect the insulated wires, and conductors inside the insulators are exposed. The insulators may be stripped off at the end portions of the insulated wires, or at the middle portions of the insulated wires, which are not limited specifically.

Figure 3B:
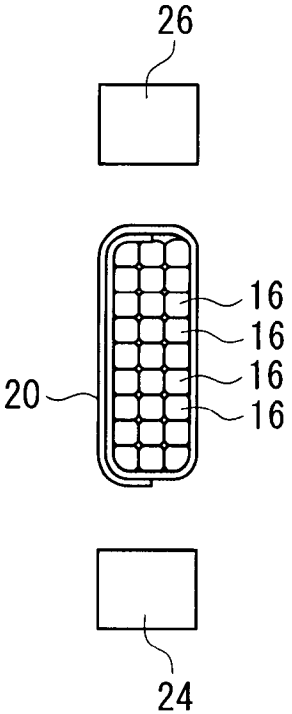
FIGS. 3A and 3B are views for illustrating a process of ultrasonic welding a plurality of insulated wires, where the view shown in FIG. 3A is seen in a direction perpendicular to an axial direction of the insulated wires and the view shown in FIG. 3B is seen in the axial direction of the insulated wires.
Figure 3A:
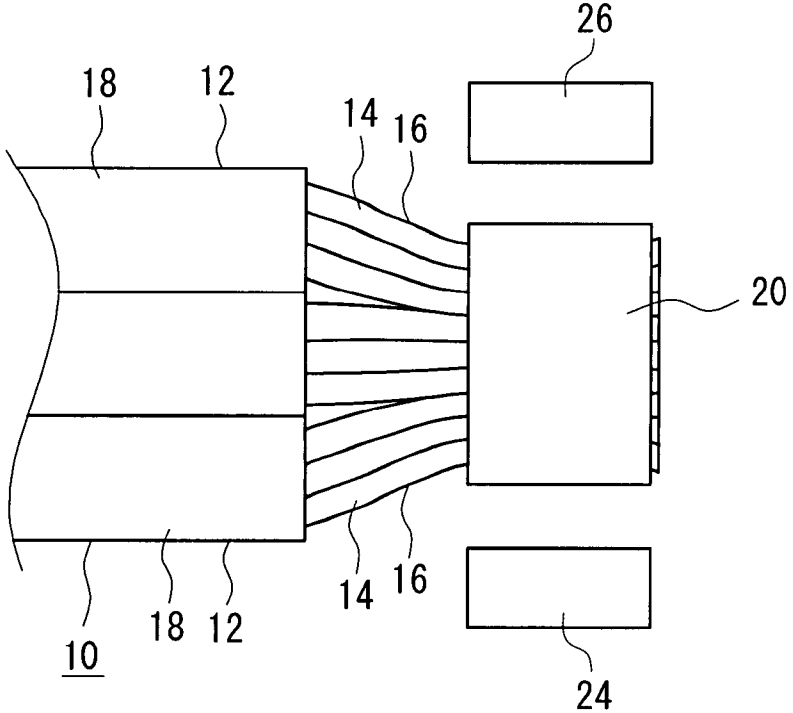

Next, in the step of binding the insulated wires, the obtained insulated wires are bound with a metal leaf or a metal wire at sites where the conductors are exposed. Shown in FIGS. 3A and 3B is an example of a wiring harness where insulated wires of which insulators are partially stripped off at the end portions and conductors are exposed are bound with a metal leaf at sites where the conductors are exposed.

When the insulated wires are bound with the metal leaf, a total thickness of the metal leaf covering the conductors and a winding number of the metal leaf are preferably in the above-described ranges. Alternatively, when the insulated wires are bound with the metal wire, the diameter of the metal wire and the intervals at which the metal wire is wound around the conductors are preferably in the above-described ranges.

Then, in the step of joining elemental wires, elemental wires included in the conductors are joined together while the conductors are bound with the metal leaf or the metal wire.

Examples of a method for joining the elemental wires include an ultrasonic welding method and a resistance welding method. Among these methods, the ultrasonic welding method is preferably used considering its easy operation and reliable joining capability. In order to perform ultrasonic welding and resistance welding, a common ultrasonic welding machine and a common resistance welding machine are preferably used, respectively.

FIGS. 3A and 3B are views showing an example of joining the elemental wires 16 by the ultrasonic welding method. As shown in FIGS. 3A and 3B, the portion of the insulated wires 12 at which the conductors 14 are bound with the metal leaf 20 is firstly placed on an anvil 24 of an ultrasonic welding machine, and a hone 26 of the ultrasonic welding machine is placed at a position opposed to the anvil 24 with the bound conductors 14 interposed therebetween. Then, the hone 26 is ultrasonically oscillated while the bound conductors 14 are left interposed between the anvil 24 and the hone 26. As the hone 26 is ultrasonically oscillated, the elemental wires 16 are heated by friction to be joined together inside the metal leaf 20.

Also in a case where the conductors are bound with a metal wire, the portion where the conductors are bound with the metal wire is interposed between the anvil and the hone of the ultrasonic welding machine, and ultrasonic welding can be performed as is the case where the conductors are bound with a metal leaf.

In addition, if the elemental wires are joined together by the resistance welding method, the portion of the insulated wires at which the conductors are bound with a metal leaf or a metal wire is interposed between electrodes of a resistance welding machine (not illustrated), and resistance welding can be performed.

After passing the above-described steps, the plurality of insulated wires are bound with the metal leaf or the metal wire at the sites where the conductors are exposed, and the elemental wires included in the conductors are joined together to provide a joining portion inside the metal leaf or the metal wire. Thus, the wiring harness according to the preferred embodiments of the present invention can be produced.

Next, a description of a method for connecting insulated wires according to a preferred embodiment of the present invention will be provided.

The method for connecting insulated wires includes the steps of partly exposing conductors of a plurality of insulated wires, binding the insulated wires at sites where the conductors are exposed with a metal leaf or a metal wire, and joining elemental wires which are included in the conductors while the conductors are bound together.

The steps included in the method for connecting insulated wire according to the preferred embodiment of the present invention are performed similarly to the steps included in the above-described method for producing a wiring harness.

Consequently, the plurality of insulated wires are bound at the sites where the conductors are exposed with the metal leaf or the metal wire, and the elemental wires included in the conductors are joined together to provide a joining portion inside the metal leaf or the metal wire. Thus, the insulated wires are connected via the joining portion.

EXAMPLES

A description of the present invention will now be specifically provided with reference to examples.

Examples 1 to 6

Wiring harnesses according to Examples 1 to 6 each include two copper electric wires for automobile (main wires) in which each conductor included therein has a cross-sectional area of 0.5 $mm^2$, and one insulated wire. The insulated wires included in the wiring harnesses according to Examples 1 to 6 were prepared so as to conform to the respective requirements shown in Table 1. The wiring harnesses according to Examples 1 to 6 were each produced such that the main wires and the insulated wire were cut to 100 mm, insulators of the main wires and the insulated wire were stripped off the length of 10 mm at the end portions of the main wires and the insulated wire, and the main wires and the insulated wire were bound with a metal leaf at sites where the conductors included in the main wires and the insulated wire were exposed, and thereafter, with the use of an ultrasonic welding machine manufactured by SCHUNK ULTRASCHALLTECHNIK GMBH, the three wires were connected by ultrasonic welding at sites around which the metal leaf is wound under the standard conditions of the ultrasonic welding machine. At the time of the ultrasonic welding, imparted energy was set at an optimum value such that connecting strength is maximized. Besides, the types, total thicknesses and winding numbers of the metal leaves used in the wiring harnesses according to Examples 1 to 6 are as shown in Table 1.

Example 7

A wiring harness according to Example 7 includes two aluminum electric wires for automobile (main wires) in which each conductor included therein has a cross-sectional area of 0.5 $mm^2$, and one insulated wire. The insulated wire included in the wiring harness according to Example 7 was prepared so as to conform to the requirements shown in Table 1. The wiring harness according to Example 7 was produced similarly to the wiring harnesses according to Examples 1 to 6.

Examples 8 to 14

Wiring harnesses according to Examples 8 to 14 were produced similarly to the wiring harnesses according to Examples 1 to 7 except that, in each wiring harness, two main wires and one insulated wire were bound with a metal wire, not with a metal leaf as used in the wiring harnesses according to Examples 1 to 7. Besides, the types of the metal wires, the intervals at which the metal wires were wound around the main wires and the insulated wires in the wiring harnesses according to Examples 8 to 14, and the ratios of the winding intervals to the wire diameters are as shown in Table 1.

Comparative Examples 1 to 3

Wiring harnesses according to Comparative Examples 1 to 3 were produced similarly to the wiring harnesses according to Examples 1 to 3 except that, in each wiring harness, without being bound with a metal leaf, two main wires and one insulated wire were connected by ultrasonic welding at sites where conductors included in the main wires and the insulated wire were exposed and bunched together.

Measurement of peel strength was made on each of the wiring harnesses according to Examples 1 to 14 and Comparative Examples 1 to 3 in the following manner.

Measurement of Peel Strength

Figure 4:
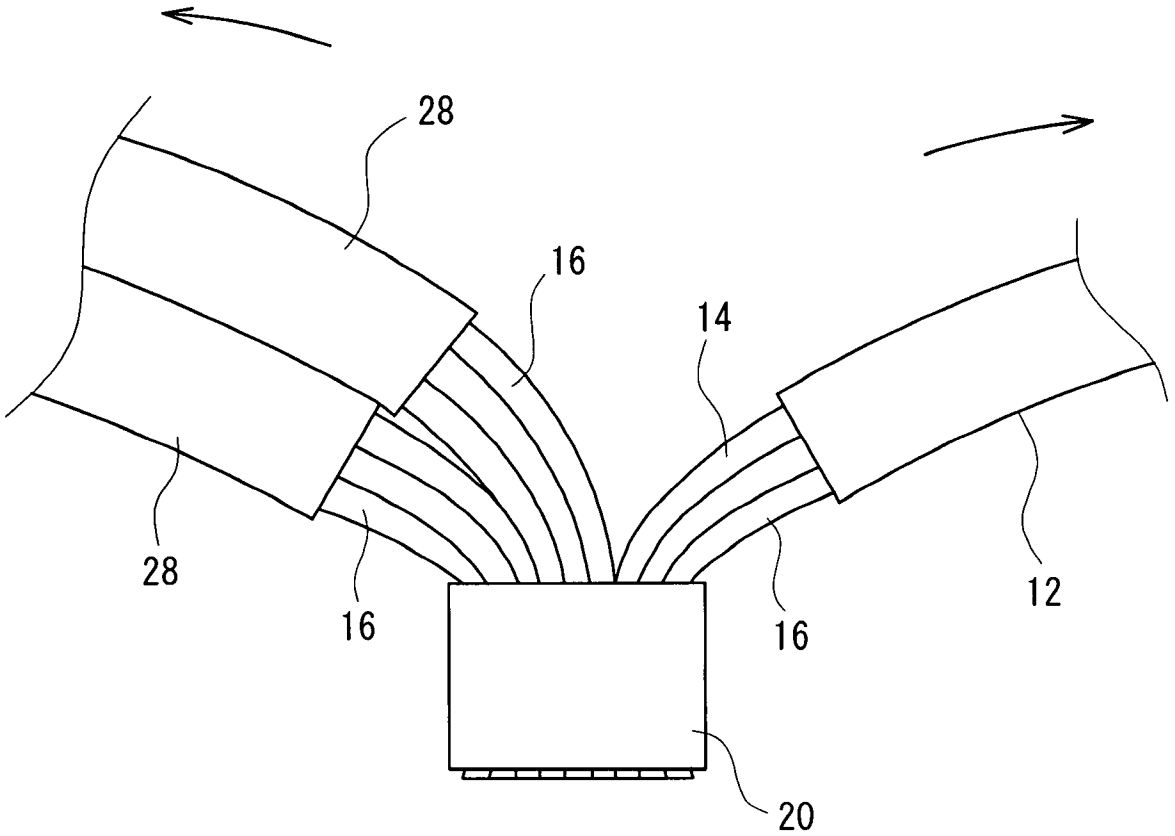
FIG. 4 is a view showing a test method of peel strength of a wiring harness.

As shown in FIG. 4, measurement of peel strength was made on each wiring harness such that two main wires 28 and an insulated wire 12 were pulled in directions opposed to each other by a common tensile tester, and an ultimate load obtained when the insulated wire 12 peeled off the main wires 28 at a joining portion where the wires were joined together was measured.

The measurement results of the wiring harnesses according to Examples 1 to 7 are shown in Table 1, and the measurement results of the wiring harnesses according to Examples 8 to 14 are shown in Table 2.

provided with a joining portion between the dissimilar metals, the wiring harness according to Comparative Example 1 is inferior in peel strength at the joining portion.

In the wiring harness according to Comparative Example 2, the conductors of the main wires and the conductor of the insulated wire are all made from tough pitch copper; however, since the conductor of the insulated wire has a small cross-sectional area, the wiring harness according to Comparative Example 2 is inferior in peel strength at a joining portion.

In the wiring harness according to Comparative Example 3, the conductor of the insulated wire is made from a copper alloy while the conductors of the main wires are made from a metal different from the copper alloy. Accordingly, being provided with a joining portion between the dissimilar metals, the wiring harness according to Comparative Example 3 is inferior in peel strength at the joining portion.

Meanwhile, in the wiring harnesses according to Examples 1 to 3, though the main wires and the insulated wires have the same cross-sectional areas and are made up from the same elemental wires and the same reinforcement wire if any as the wiring harnesses according to Comparative Examples 1 to 3

TABLE 1

| | | Insulated wire | | | Metal Leaf | | | | |
|---|---|---|---|---|---|---|---|---|---|
| | | Conductor Cross-Sectional Area ($mm^2$) | Elemental Wire Material | Reinforcement Wire Material | Type | Thickness (mm) | Winding Number (number of times) | Total Thickness (mm) | Peel Strength (N) |
| Example | 1 | 0.13 | Tough Pitch Copper | Stainless Steel | Copper Leaf | 0.03 | 2 | 0.06 | 16.1 |
| | 2 | 0.22 | Tough Pitch Copper | — | Copper Leaf | 0.03 | 2 | 0.06 | 15.3 |
| | 3 | 0.13 | Copper Alloy | — | Copper Leaf | 0.03 | 2 | 0.06 | 18.6 |
| | 4 | 0.13 | Tough Pitch Copper | Stainless Steel | Copper Leaf | 0.01 | 2 | 0.02 | 11.6 |
| | 5 | 0.13 | Tough Pitch Copper | Stainless Steel | Copper Leaf | 0.1 | 4 | 0.4 | 10.5 |
| | 6 | 0.22 | Tough Pitch Copper | Stainless Steel | Copper Leaf | 0.01 | 10 | 0.1 | 17.4 |
| | 7 | 0.35 | Aluminum Alloy | — | Aluminum Leaf | 0.05 | 3 | 0.15 | 16.5 |
| Comparative Example | 1 | 0.13 | Tough Pitch Copper | Stainless Steel | — | — | — | — | 7.3 |
| | 2 | 0.22 | Tough Pitch Copper | — | — | — | — | — | 9.5 |
| | 3 | 0.13 | Copper Alloy | — | — | — | — | — | 10.5 |

TABLE 2

| | | Insulated wire | | | Metal Wire | | | | |
|---|---|---|---|---|---|---|---|---|---|
| | | Conductor Cross-Sectional Area ($mm^2$) | Elemental Wire Material | Reinforcement Wire Material | Type | Wire Diameter (mm) | Winding Interval (mm) | Winding Interval/ Wire Diameter | Peel Strength (N) |
| Example | 8 | 0.13 | Tough Pitch Copper | Stainless Steel | Soft Copper Wire | 0.26 | 2 | 7.7 | 32.1 |
| | 9 | 0.22 | Tough Pitch Copper | — | Soft Copper Wire | 0.26 | 2 | 7.7 | 29.4 |
| | 10 | 0.13 | Copper Alloy | — | Soft Copper Wire | 0.26 | 2 | 7.7 | 35.9 |
| | 11 | 0.13 | Tough Pitch Copper | Stainless Steel | Soft Copper Wire | 0.05 | 2.5 | 50 | 12.6 |
| | 12 | 0.13 | Tough Pitch Copper | Stainless Steel | Soft Copper Wire | 0.5 | 10 | 20 | 46.8 |
| | 13 | 0.22 | Tough Pitch Copper | Stainless Steel | Soft Copper Wire | 0.1 | 0.8 | 4 | 20.4 |
| | 14 | 0.35 | Aluminum Alloy | — | Soft Aluminum Wire | 0.32 | 2 | 6.25 | 40.2 |
| Comparative Example | 1 | 0.13 | Tough Pitch Copper | Stainless Steel | — | — | — | — | 7.3 |
| | 2 | 0.22 | Tough Pitch Copper | — | — | — | — | — | 9.5 |
| | 3 | 0.13 | Copper Alloy | — | — | — | — | — | 10.5 |

In the wiring harness according to Comparative Example 1, a reinforcement wire made from a stainless steel is further included in the conductor of the insulated wire which is joined with the conductors of the main wires. Accordingly, being respectively, the conductors of the main wires and the conductors of the insulated wires are bound further with the copper leaves so as to cover the joining portions. In the wiring harnesses according to Examples 8 to 10, though the main wires and the insulated wires have the same cross-sectional areas and are made up from the same elemental wires and the reinforcement wire if any as the wiring harnesses according to Comparative Examples 1 to 3 respectively, the conductors of the main wires and the conductors of the insulated wires are bound further with the copper wires. Consequently, based on the measurement results of Examples 1 to 3 and 8 to 10, it is shown that the use of the copper leaves or the copper wires provides the wiring harnesses according to Examples 1 to 3 and 8 to 10 with excellent peel strength at the joining portions.

In the wiring harnesses according to Examples 4 to 7 and 11 to 14, the main wires and the insulated wires have cross-sectional areas and are made up from the elemental wires and the reinforcement wires if any which are different from the wiring harnesses according to Comparative Examples 1 to 3, and the conductors of the main wires and the conductors of the insulated wires are bound with the metal leaves or the metal wires. Consequently, based on the measurement results of Examples 4 to 7 and 11 to 14, it is shown that the use of the metal leaves or the metal wires provides the wiring harnesses according to Examples 4 to 7 and 11 to 14 with excellent peel strength at the joining portions.

The foregoing description of the preferred embodiments of the present invention has been presented for purposes of illustration and description; however, it is not intended to be exhaustive or to limit the present invention to the precise form disclosed, and modifications and variations are possible as long as they do not deviate from the principles of the present invention.

For example, the form of the metal leaf with which the exposed conductors are bound is not limited to the form that the metal leaf is wound around the exposed conductors as shown in FIG. 1. It is also preferable that the metal leaf is cylindrical or square tubular in form so as to house the exposed conductors therein to bunch them.

The invention claimed is:

1. A wiring harness comprising:

a plurality of insulated wires whose conductors are partly exposed; and one of a metal leaf and a metal wire, with which the exposed conductors are bound, wherein:

the conductors including elemental wires have a first joining portion where the elemental wires are joined together, the conductors including the elemental wires have a second joining portion where the elemental wires and one of the metal leaf and the metal wire are joined together, the first and the second joining portions being inside the one of the metal leaf and the metal wire which is wound around the first and second joining portions, the one of the metal leaf and the metal wire is made from one of a same metal as or alloy of a same metal from which the elemental wires of the conductors are made, and both (i) the first joining portion and (ii) the second joining portion are joined together at the same time by one of ultrasonic welding and resistance welding.

2. The wiring harness according to claim 1, wherein the elemental wires are made from one or more metals selected from the group consisting of copper, a copper alloy, aluminum, and an aluminum alloy.

3. The wiring harness according to claim 1, wherein at least one of the conductors further includes a reinforcement wire.

4. The wiring harness according to claim 1, wherein at least one of the conductors has a cross-sectional area of 0.35 $mm^2$ or less.

5. The wiring harness according to claim 1, wherein a total thickness of the metal leaf covering the conductors is in a range of 0.02 to 0.4 mm.

6. The wiring harness according to claim 1, wherein a diameter of the metal wire is in a range of 0.05 to 0.5 mm.

7. The wiring harness according to claim 6, wherein the metal wire is wound around the conductors at intervals of 1 to 50 times the diameter of the metal wire.

8. The wiring harness of claim 1, wherein the elemental wires include at least one elemental wire having a diameter that is smaller than other elemental wires of the elemental wires.

9. A method for producing a wiring harness, the method comprising the steps of:

partly exposing conductors of a plurality of insulated wires;

binding the insulated wires at sites where the conductors are exposed with one of a metal leaf and a metal wire; and joining elemental wires which are included in the conductors while the conductors are bound together, the elemental wires have a first joining portion where the elemental wires are joined together, wherein the elemental wires have a second joining portion where the elemental wires and one of the metal leaf and the metal wire are joined together, wherein:

both (i) the first joining portion and (ii) the second joining portion are joined together at the same time by one of ultrasonic welding and resistance welding after the binding the insulated wires with the one of the metal leaf and the metal wire, and the one of the metal leaf and the metal wire are made from one of a same metal as or alloy of a same metal from which the elemental wires of the conductors are made.

10. A method for connecting insulated wires, the method comprising the steps of:

partly exposing conductors of a plurality of insulated wires;

binding the insulated wires at sites where the conductors are exposed with one of a metal leaf and a metal wire; and joining elemental wires which are included in the conductors while the conductors are bound together, the elemental wires have a first joining portion where the elemental wires are joined together, wherein the elemental wires have a second joining portion where the elemental wires and one of the metal leaf and the metal wire are joined together, wherein:

both (i) the first joining portion and (ii) the second joining portion are joined together at the same time by one of ultrasonic welding and resistance welding after the binding the insulated wires with one of the metal leaf and the metal wire, and the one of the metal leaf and the metal wire are made from one of a same metal as or alloy of a same metal from which the elemental wires of the conductors are made.

* * * * *

UNITED STATES PATENT AND TRADEMARK OFFICE

CERTIFICATE OF CORRECTION

PATENT NO. : 8,921,696 B2
APPLICATION NO. : 12/450270
DATED : December 30, 2014
INVENTOR(S) : Yasuyuki Otsuka et al.

It is certified that error appears in the above-identified patent and that said Letters Patent is hereby corrected as shown below:

Title Page

Assignees (73), delete "Sumitomo Wiring Systems, Ltd., Mie (JP); Autonetworks Technologies, Ltd., Mie (JP); Sumitomo Electric Industries, Ltd., Osaka (JP)" and insert --Autonetworks Technologies, Ltd., Mie (JP); Sumitomo Wiring Systems, Ltd., Mie (JP); Sumitomo Electric Industries, Ltd., Osaka (JP)--, therefor.

Signed and Sealed this
Fourteenth Day of April, 2015

Michelle K. Lee

Michelle K. Lee
*Director of the United States Patent and Trademark Office*